US008613370B2

(12) United States Patent
Wong

(10) Patent No.: US 8,613,370 B2
(45) Date of Patent: Dec. 24, 2013

(54) MOUNTING DEVICE AND ASSOCIATED CONTAINER

(76) Inventor: Fun Wah Arthur Wong, Hong Kong (HK)

( * ) Notice: Subject to any disclaimer, the term of this patent is extended or adjusted under 35 U.S.C. 154(b) by 256 days.

(21) Appl. No.: 13/087,681

(22) Filed: Apr. 15, 2011

(65) Prior Publication Data

US 2011/0186539 A1 Aug. 4, 2011

Related U.S. Application Data

(60) Continuation of application No. 12/395,853, filed on Mar. 2, 2009, now abandoned, which is a division of application No. 11/357,658, filed on Feb. 21, 2006, now abandoned, which is a continuation of application No. PCT/NZ2004/000138, filed on Jul. 1, 2004.

(51) Int. Cl.
*B65D 25/22* (2006.01)
*B65D 21/02* (2006.01)
*B65D 39/00* (2006.01)

(52) U.S. Cl.
USPC ..... 220/475; 220/23.91; 215/255

(58) Field of Classification Search
USPC ..... 220/475, 23.91, 505, 495.05, 23.83, 220/521, 522, 529, 212, 735, 741–742, 532, 220/359.2, 256.1, 257.2; 206/216, 223; 426/120; 215/255, 257, 250, 251, 215/246–249, 386, 390
See application file for complete search history.

(56) References Cited

U.S. PATENT DOCUMENTS

| | | | | |
|---|---|---|---|---|
| 4,874,101 | A * | 10/1989 | Zalut | 215/251 |
| 5,318,787 | A * | 6/1994 | Brauner et al. | 426/120 |
| 5,667,086 | A * | 9/1997 | Guerre | 215/251 |
| 6,102,233 | A * | 8/2000 | Waugh | 220/23.86 |
| 6,244,554 | B1 * | 6/2001 | Baker | 248/312 |
| 6,350,225 | B1 * | 2/2002 | Sheeran et al. | 494/12 |
| 2004/0124102 | A1 * | 7/2004 | Chalmers | 206/216 |

* cited by examiner

*Primary Examiner* — Bryon Gehman
*Assistant Examiner* — Shawn Braden
(74) *Attorney, Agent, or Firm* — Eric Hanscom; Todd J. Langford

(57) ABSTRACT

A mounting device comprising a sleeve carrying thereon a receiving means, the sleeve having internally thereof holding means to enable, in use, the sleeve to be mounted on the neck of a bottle, or the like article, in manner such that removal of the sleeve from the neck is resisted, and the receiving means comprising a flange extending outwardly of the sleeve to, in use, provide means whereby an article may be held to the sleeve, the internal diameter of the sleeve being such that the sleeve may be passed onto the neck of a bottle or the like.

6 Claims, 6 Drawing Sheets

MOUNTING DEVICE AND ASSOCIATED CONTAINER

CROSS REFERENCE TO RELATED APPLICATIONS

This application is a continuation of U.S. patent application Ser. No. 12/395,853 filed on Mar. 2, 2009, which in turn is a divisional of U.S. patent application Ser. No. 11/357,658 filed on Feb. 21, 2006, now abandoned, which in turn is a continuation of PCT Application No. PCT/NZ04/00138 filed on Aug. 29, 2003, the entireties of which are hereby incorporated by reference.

STATEMENT REGARDING FEDERALLY SPONSORED RESEARCH OR DEVELOPMENT

This invention was not federally sponsored.

BACKGROUND OF THE INVENTION

1. Field of the Invention

This invention relates to a mounting device and has been devised particularly to enable articles to be mounted on the neck of a bottle. It will be apparent however that the device will also allow articles to be mounted on constructions similar to the neck of a bottle or other objects having a shape similar to such a neck.

2. Background Art

In commerce today it has become increasingly common to give away gifts, prizes, or promotional items with a purchase. The gift, prize, or promotional item can be supplied separately to the purchase which increase time, at for example, a supermarket check-out or the presenting of the gift, prize, or promotional item can easily be overlooked leading to customer dissatisfaction. The gift, prize or promotional item may alternatively be attached to the product being purchased. Difficulties arise however in that frequently the gift, promotional item or prize is able to be easily removed from the product with which it is sold or otherwise provided. In the event that the item is so removed from the product, then instead of acting as an incentive to buy the product, there can in fact be a disincentive to buy the product particularly where the gift, promotional item, or prize has been widely promoted. Where the product is a bottle, it is also necessary that the promotional item, gift or prize, or any packaging within which it is contained, does not extend to any substantial extent beyond the maximum transverse diameter of the bottle. If the gift were larger than that size, extra volume would be required to store, transport or display the items. Of lesser importance, but also a consideration, is the need to minimize any additional height to the bottle during any particular transportation or storage.

OBJECT OF THE INVENTION

It is therefore an object of the present invention to provide a mounting device which will go at least some way towards obviating or minimizing the foregoing disadvantages and/or going at last some way towards meeting the foregoing requirements in a simple yet effective manner or which will at least provide the public with a useful choice.

STATEMENT OF THE INVENTION

Accordingly, one aspect the invention includes a mounting device comprising a sleeve carrying thereon a receiving means, the sleeve having internally thereof holding means to enable, in use, the sleeve to be mounted on the neck of a bottle, or the like article, in a manner such that removal of the sleeve from the neck is resisted, and the receiving means comprising a flange extending outwardly of the sleeve to, in use, provide means whereby an article may be held to the sleeve, the internal diameter of the sleeve being such that the sleeve may be passed onto the neck of a bottle or the like.

Preferably the maximum diameter of the flange is equal to or less than the maximum diameter of the bottle or the like.

Preferably the flange is provided adjacent one end of the sleeve.

Alternatively the flange is positioned intermediate of the length of the sleeve.

Preferably the holding means comprises a plurality of inwardly extending teeth within the sleeve.

Alternatively the holding means comprises an inwardly extending rib within the sleeve.

Preferably the sleeve includes a tear strip.

A further aspect the invention includes a mounting device according to any one of the preceding paragraphs and an article secured to the flange, or at least in part secured by the flange.

Preferably the article comprises an opened mouth vessel, the mouth of the vessel being positioned adjacent the flange.

Preferably the vessel is secured to the flange by wrapping material.

Alternatively the article comprises a package having a pair of substantially opposite apertures therein, the sleeve passing through the apertures and the flange being positioned adjacent the material defining one said aperture.

A further aspect the invention includes a mounting device and an article secured thereon according to any one of the preceding paragraphs mounted on the neck of a bottle or the like device.

There has thus been outlined, rather broadly, the more important features of the invention in order that the detailed description thereof may be better understood, and in order that the present contribution to the art may be better appreciated. There are additional features of the invention that will be described hereinafter and which will form the subject matter of the claims appended hereto. The features listed herein and other features, aspects and advantages of the present invention will become better understood with reference to the following description and appended claims. The accompanying drawings, which are incorporated in and constitute part of this specification, illustrate embodiments of the invention and, together with the description, serve to explain the principles of the invention.

BRIEF DESCRIPTION OF THE FIGURES

One preferred form of the invention will now be described with reference to the accompanying drawings.

BEST MODE FOR CARRYING OUT THE INVENTION

Figure 3:
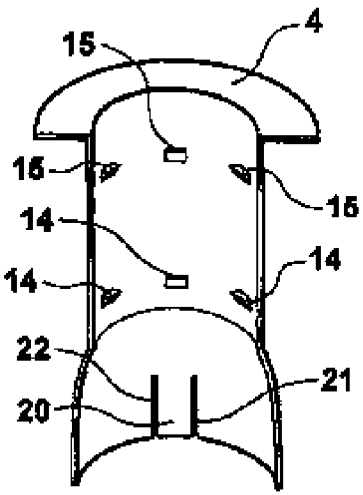
FIGS. 2 and 3 are cross-sectional views of alternative constructions of the type shown in FIG. 1.

Many aspects of the invention can be better understood with references made to the drawings below. The components in the drawings are not necessarily drawn to scale. Instead, emphasis is placed upon clearly illustrating the components of the present invention. Moreover, like reference numerals designate corresponding parts through the several views in the drawings.

Figure 1:
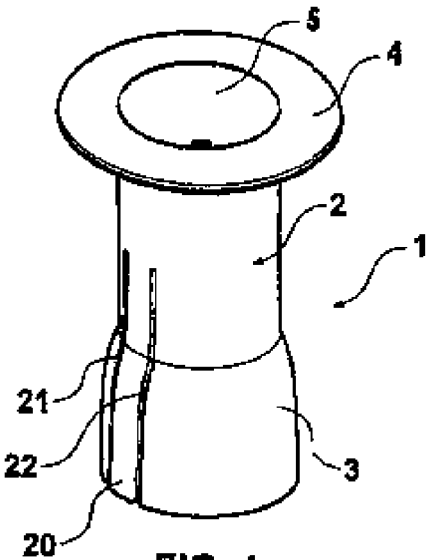
FIG. 1 is a perspective view of a mounting device according to a preferred form of the invention

In the preferred forms of the invention FIG. 1 shows a mounting device 1 which is in the form of a sleeve 2. The lower end of the sleeve 2 may be widened or broadened as at 3 so as to fit (in use) a neck, such as the neck of a bottle. A close fit is preferred. The sleeve 2 carries a receiving means preferably in the form of a flange 4. The flange 4 is shown in the form of an annulus having a central opening 5, but the perimeter shape could be any desirable shape such as square, octagonal, ellipsoidal or otherwise.

The mounting device may be formed from any suitable material, preferably a plastics material which has substantial rigidity but which can flex to at least some extent, as will be described further hereinafter.

Figure 2:
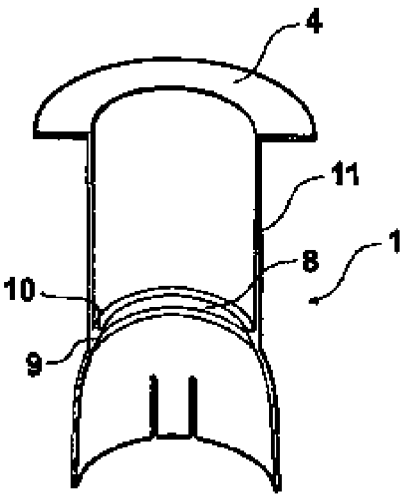

A holding means is provided preferably internally of the sleeve to hold the device on a bottle. In the construction of FIG. 2 the holding device takes the form of an inwardly extending rib 8 preferably having a sloped face 9 and a further face 10 which lies in a plane substantially perpendicular to the plane of the wall 11 of the sleeve 2. The slope of face 9 is selected to allow the sleeve to be pushed onto a bottle neck without undue pressure being required. Thus (in use) when the sleeve is placed over the neck, for example, of a bottle, the annular rib 8 can be forced over the thickened part of the bottle neck and catch therebelow thereby substantially resisting removal of the sleeve from the bottle. The sleeve 2 will expand to allow this to occur, or alternatively the rib 8 can deform to allow the sleeve 2 to be forced onto the bottle neck.

In the construction of FIG. 3 the inwardly extending rib 8 is replaced by a number of teeth or catches 14 which serve substantially the same purpose as rib 8. Again the teeth or catches 14 have a sloped surface and a substantially perpendicular surface.

Figures 4, 5, 6, 7:
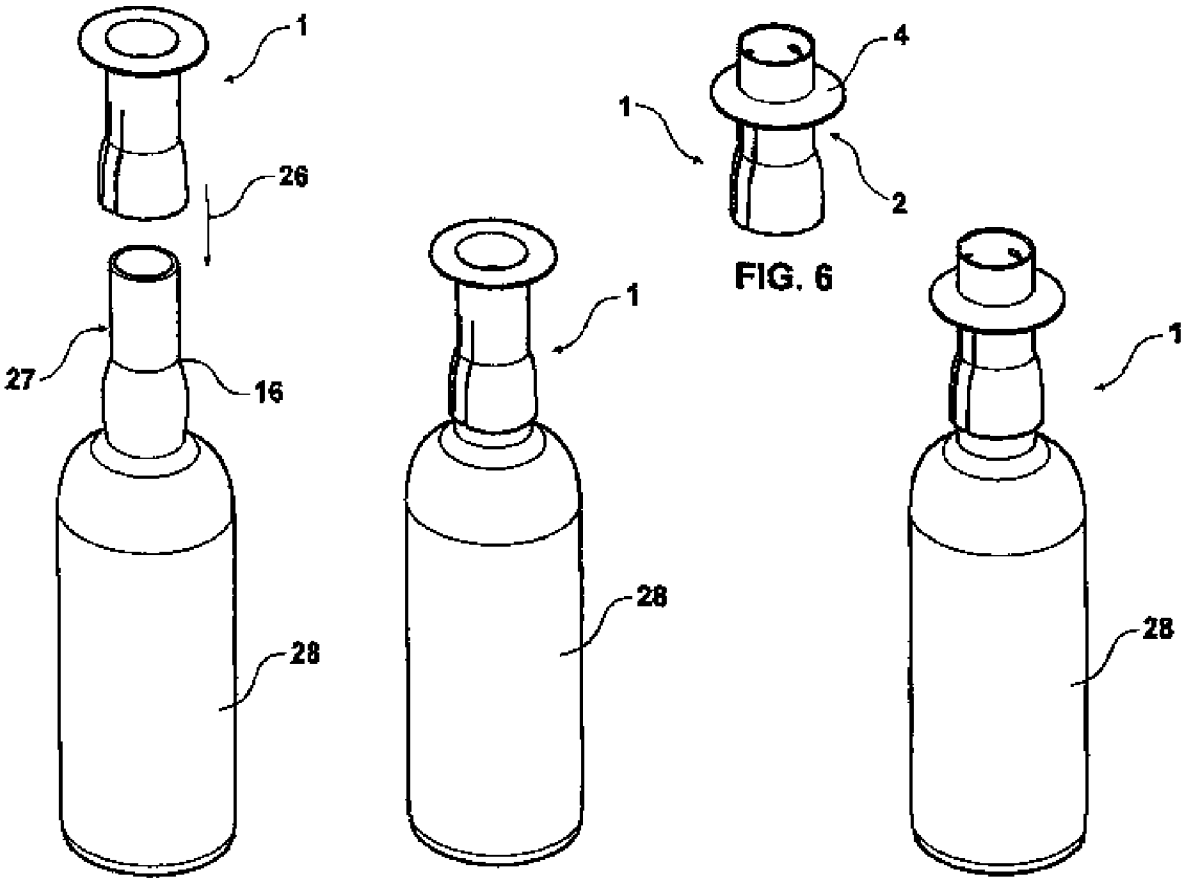
FIG. 4 is an exploded view of the mounting device of FIG. 1 in conjunction with a bottle.
FIG. 5 is a side elevation of the construction of FIG. 4, but with the mounting device in position on the bottle.
FIG. 6 is a view as in FIG. 1 of an alternative mounting device.
FIG. 7 is a view as in FIG. 5 showing the alternative mounting device.

A further circle of the teeth or catches 15 may be provided so as to allow a range of catches or teeth which may fit under the annular protrusion indicated at 16 in FIG. 4.

It will be apparent that any selected number of ribs or catches may be provided and indeed in FIG. 2 a plurality of spaced apart inwardly extending ribs 8 can be provided to again provide positioning choice of the sleeve 2 on the neck.

As the mounting device 1 is intentionally difficult to remove once in position on a bottle, removal at the intended time can be assisted by providing a pull tab 20. The pull tab 20 can be provided by forming a pair of spaced apart parallel slits 21 and 22 in the material. The slits 21 or 22 extend some distance up the sleeve 2, and in use, the slits could in part be weakened lines if desired. Pulling on the pull tab 20 will split the sleeve 2 to facilitate removal thereof in use.

In FIG. 4 the mounting device 1 moves in the direction of arrow 26, relative to neck 27, so that the neck 27 of the bottle passes up through the interior bore of the sleeve 2 until positioned by the catches 14 or 15, or the rib 8, FIG. 5 shows the mounting device 1 in position on a bottle 28.

The construction of FIG. 6 is substantially similar save that the flange 4 is not positioned at the upper end (in use) of the sleeve 2, but rather at an intermediate position. The precise position can be varied to suit particular demands of the gift, promotional item or prize.

FIG. 7 shows the mounting device 1 of FIG. 6 in opposition on a bottle 28.

Figure 8:
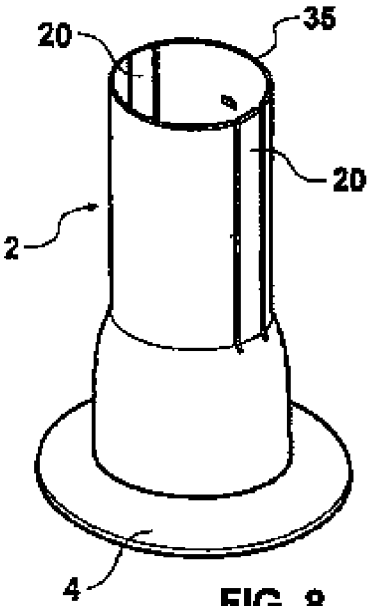
FIG. 8 is a perspective view of a yet another mounting device.
Figure 12:
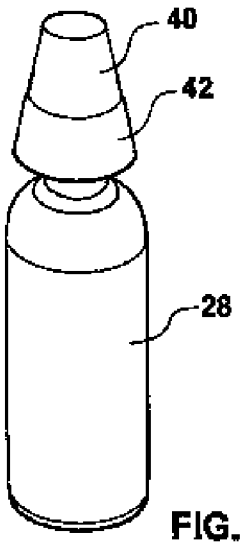
FIG. 12 shows the construction of FIG. 11 consolidated and finalized.

FIG. 8 shows a yet further variation in which the flange 4 is at the lower end (in use) of the sleeve 2. In this construction the tear-tabs 20 extend from the upper edge 35 of the sleeve 2.

Figure 9:
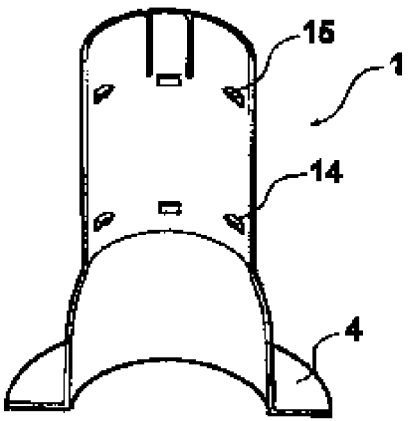
FIG. 9 is a cross-sectional view of the mounting device of FIG. 8.

FIG. 9 is a view substantially as in FIG. 3 of the embodiment of FIG. 8 wherein rows of catches 14 and 15 are again shown. As can be seen even in the embodiments of FIGS. 8 and 9 the catches are positioned substantially as in FIG. 3.

Figure 10:
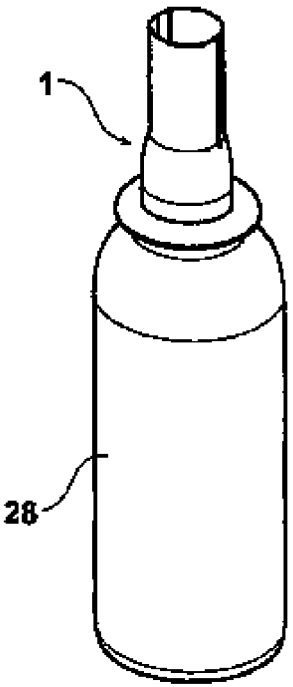
FIG. 10 is a view as in FIGS. 5 and 7 of the mounting device of FIG. 9.

FIG. 10 shows the mounting device 1 of FIGS. 8 and 9 in position on a bottle 28.

Figure 11:
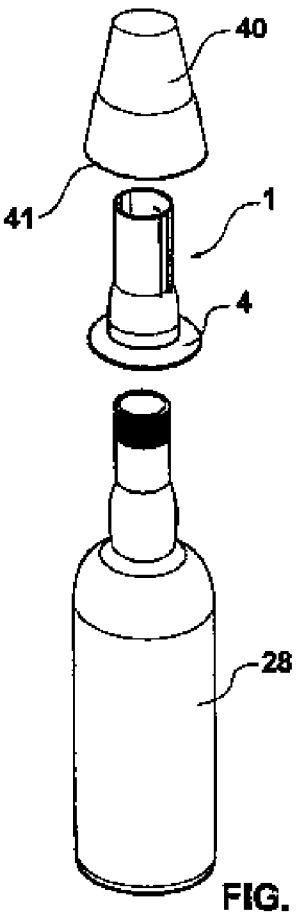
FIG. 11 is a view as in FIG. 4, but with the mounting device of FIG. 9 and a vessel which is to be attached thereto.

FIG. 11 shows an exploded form, the mounting device 1 and bottle 28 with a vessel in the form of a glass 40 which may be used as a gift, promotional item or prize or otherwise in relation to the bottle 28. Thus, for example, the vessel 40 may provide a drinking glass when the bottle is opened.

In use the mounting device 1 is positioned so that the sleeve 2 is placed onto the neck of the bottle 28 substantially as shown in FIG. 10. The vessel 40 is then inverted so that the mouth end 41 becomes positioned adjacent, around or on the flange 4. The vessel 40 is then secured by a wrapping material 42 which may be, for example, shrink wrapping material which will substantially resist removal of the vessel 40 from the mounting device 1.

Figure 13:
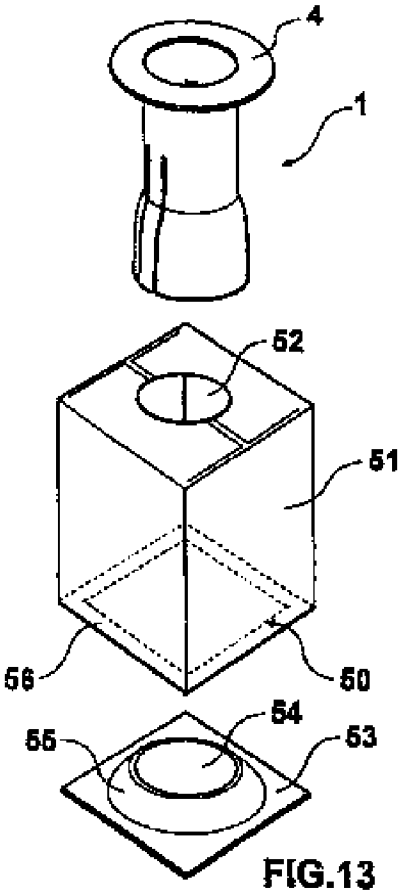
FIG. 13 shows a package in conjunction with the mounting device of FIG. 1.

Referring now to FIG. 13, an alternative is provided in which a package 50, which can be vacuum formed, is provided which has a box part 51 with a substantially centrally positioned aperture 52 therein and a base part 53 with an aperture 54 possibly, and preferably, with an inwardly extending wall 55 which tapers inwardly away from the base part 53.

The box part 51 has an inwardly turned flange 56 at its lower end enabling the base part 53 to be attached thereto, for example, by gluing, heat welding or in any other suitable manner.

The mounting device 1, which in this case is of the form shown in FIG. 1, can be passed through the aligned apertures 52 and 53 until the flange 4 is adjacent, or at least close to, the upper face 54, in use, of the passage 50 and then the construction can be engaged with the neck of a bottle, as described above. In this embodiment the package is effectively clamped between the flange 4 and the parts of the bottle which form the shoulder 58 of the bottle 28.

It is not essential for the sleeve 2 to pass completely through the package 50 providing that there is satisfactory engagement between the sleeve 2 and the bottle neck, as the package will be held between the flange 4 and the shoulders of the bottle 28.

Figure 14:
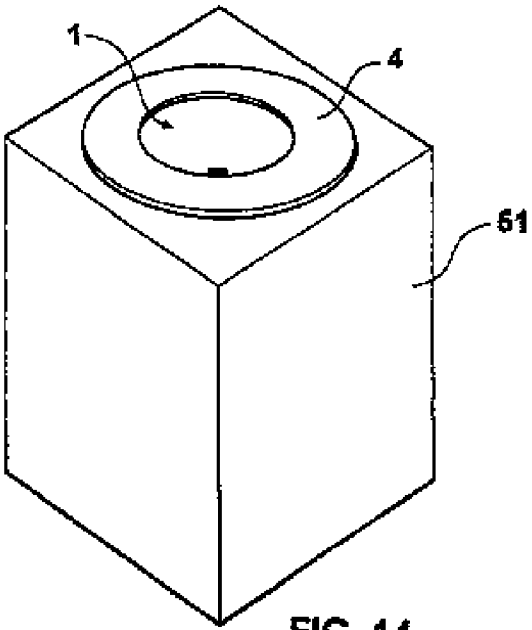
FIG. 14 is a perspective view showing the mounting device and package of FIG. 13 in an assembled form.
Figure 16:
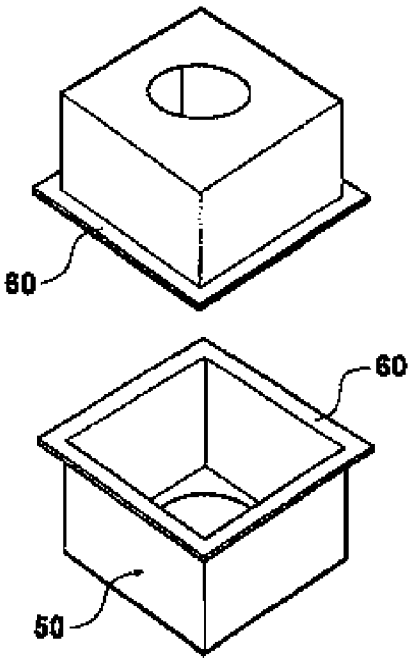
FIG. 16 is an exploded perspective view of an alternative package.
Figure 15:
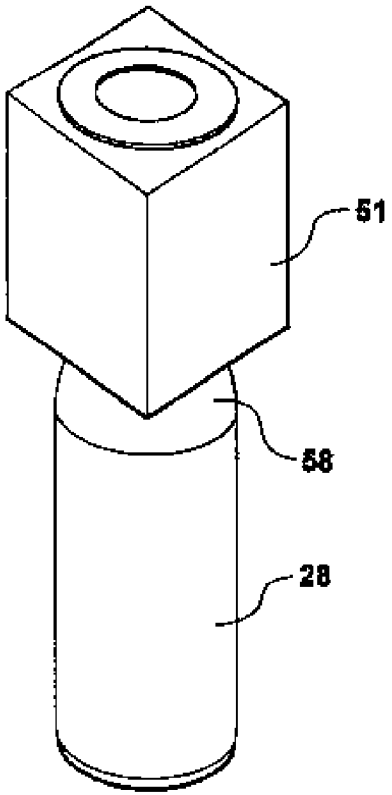
FIG. 15 is a perspective view showing the package and mounting device of FIG. 14 in position on the neck of a bottle.

FIG. 16 is substantially similar to the constructions of FIGS. 13 to 15 save that the package 50 is provided in two substantially similar parts each with a surrounding flange 60 which can be engaged by adhesives, heat welding or otherwise as desired.

It will be apparent that a gift, promotional item or prize, or other item can be contained within the package 50 in use.

In use the construction is such that a gift, prize or promotional item such as the vessel 40 or the package 50 with an item therein can be engaged either with the mounting device 1, as in the case of the vessel 40, or clamped between the flange 4 of the mounting device 1 and the shoulder 58 of a bottle 28. The engagement of the mounting device makes it more difficult to remove the mounting device form the neck of a bottle than is the case with most other means of attaching items to the neck of a bottle.

It will also be apparent that the constructions can be dimensioned so that the whole of the mounting device and package or vessel attached thereto can be within the maximum horizontal or transverse dimensions of the bottle.

It is also clear that the construction can be structured in such a way that the overall height of a bottle is not significantly increased. For example, in the case of the drinking vessel the overall height of the construction is in effect increased only by the thickness of the base of the drinking vessel if that is placed closely adjacent to the closure device of the bottle.

Thus it can be seen that at least in the preferred form of the invention, a mounting device is provided which allows a gift, promotional item or prize, or other item to be securely attached to a construction having a neck, such as a bottle. The construction is such that the mounting device and its attached item are not readily removed, thereby substantially reducing theft from bottles when they are on display.

However, if it is desired to remove the sleeve, this is possible by destroying the mounting device, for example, by use of the tear tab.

It should be understood that while the preferred embodiments of the invention are described in some detail herein, the present disclosure is made by way of example only and that variations and changes thereto are possible without departing from the subject matter coming within the scope of the following claims, and a reasonable equivalency thereof, which claims I regard as my invention.

All of the material in this patent document is subject to copyright protection under the copyright laws of the United States and other countries. The copyright owner has no objection to the facsimile reproduction by anyone of the patent document or the patent disclosure, as it appears in official governmental records but, otherwise, all other copyright rights whatsoever are reserved.

That which is claimed:

1. A device for securing one or more articles to a bottle comprising a mounting device, where the mounting device comprises a sleeve, a flange, a pull tab, and one or more inwardly extending annular ribs, where the sleeve comprises a broadened section at its lower end, where the flange is an annulus having a central opening, a base, where the base comprises an aperture and an inwardly extending wall, and a package, where the package comprises two apertures and an inwardly turned flange at its lower end, wherein the one or more articles are located within the package.

2. The device of claim 1, wherein the one or more inwardly extending annular ribs consists of a single rib.

3. The device of claim 1, wherein the one or more inwardly extending annular ribs comprises a plurality of ribs.

4. The device of claim 1, wherein the pull tab is formed by a pair of spaced apart parallel slits in the sleeve.

5. The device of claim 1, wherein the lower end of the package is attached to the base.

6. The device of claim 1, wherein the package is secured to the bottle between the base and the flange of the mounting device.

* * * * *